US006491772B1

(12) United States Patent
Scappaticci et al.

(10) Patent No.: US 6,491,772 B1
(45) Date of Patent: Dec. 10, 2002

(54) SOLDERABLE ALUMINUM

(75) Inventors: Anthony Scappaticci, Pickering (CA); Peter John Donovan, Aurora (CA)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/554,977

(22) PCT Filed: Dec. 2, 1998

(86) PCT No.: PCT/US98/25538

§ 371 (c)(1), (2), (4) Date: Sep. 18, 2000

(87) PCT Pub. No.: WO99/28516

PCT Pub. Date: Jun. 10, 1999

Related U.S. Application Data

(60) Provisional application No. 60/067,251, filed on Dec. 2, 1997.

(51) Int. Cl.[7] ..... C22F 1/04

(52) U.S. Cl. ..... 148/695; 148/437; 420/528

(58) Field of Search ..... 148/695, 437, 148/438, 439, 440; 420/528, 530

(56) References Cited

U.S. PATENT DOCUMENTS 507,822 A * 10/1893 Lancon ..... 420/530
3,827,882 A * 8/1974 Lloyd et al. ..... 75/138

FOREIGN PATENT DOCUMENTS

JP 60033896 A * 2/1985

OTHER PUBLICATIONS

Derwent English Language Abstract of Japanese Patent Document JP60033896A, Feb. 21, 1985.*

* cited by examiner

*Primary Examiner*—John Sheehan
*Assistant Examiner*—Andrew L. Oltmans

(57) ABSTRACT

The invention is directed to a solderable aluminum alloy having an aluminum alloy which is formable into a substrate. The aluminum alloy has 0.05–4.5% by weight of tin added to the aluminum alloy to be formed into the substrate. The invention is also directed to a process for preparing a solderable aluminum substrate. The process includes preparing an aluminum slug with 0.05–4.5% of tin added to the aluminum slug; then rolling the aluminum slug to the desired thickness for the substrate; finally forming the rolled slug into the final shaped of the substrate.

4 Claims, No Drawings

SOLDERABLE ALUMINUM

This application is a 371 of PCT/US98/25538 filed Dec. 2, 1998 which claims benefit of Provisional Application No. 60/067,251 filed Dec. 2, 1997.

The invention is directed to an alloy of aluminum which is solderable using standard solder and soldering baths and a process for making the alloy.

The typical solder bath is made of liquid tin with some percentage of lead added thereto. There are many other components also added to the solder to improve or modify the characteristics of the solder. The solder is typically melted in a bath and the component is dipped in the bath to cover the component with the liquid solder which will subsequently solidify. This composition of solder works very well for components which are made from copper and alloys of copper such as brass. However, this solder bath does not work well for aluminum components because of the formation of an aluminum oxide layer on the outer surface of the aluminum component. The molten tin with a small amount of lead does not form a good bond to the surface of the aluminum because of the formation of the tough outer aluminum oxide layer.

Others have attempted to find a way to solder aluminum. In order to allow soldering of an aluminum component, the typical method has attempted to modify the components of the solder to allow the solder to form a good bond with the surface of the aluminum. U.S. Pat. No. 5,147,471 discloses one such solder which can be used on an oxide layer on metals and their alloys which form surface oxide layers. The composition comprises tin and zinc, germanium as a wetting agent, preferably a small amount of copper and antimony, and a grit of silicon carbide. The grit abrades any oxide layer formed on the surface of the metal as the germanium penetrates beneath the oxide layer to provide good metal to metal bonding. The germanium comprises 10% by weight of the solder so that it provides sufficient wetting action, but does not result in a melting temperature for the solder composition above about 300° C. The solder is applied to the component by first rubbing the solder against the metal surface so the grit and the solder abrades the surface while heating the surface until the solder begins to melt and the germanium penetrates the oxide layer, then brushes aside any oxide layer loosened by the solder.

It would be advantageous to use aluminum in electrical connectors, such as for electrical contacts, traces on a circuit board or some other insulator, shells, ground planes, or any other metallic application. Copper or copper alloys are typically used in these applications because of their electrical and mechanical properties. Copper and copper alloys are also easily soldered or can be plated to form solderable substrates. Aluminum has higher conductivity than copper and therefore would perform better in some situations. Aluminum is also lighter weight, which may also be an advantage in certain situations. In addition to electrical connectors, there are also other areas in which it would be advantageous to have a form of aluminum which can be easily soldered.

What is needed is a form of aluminum which can be soldered directly using standard soldering baths made from tin and which can be easily formed into components.

The invention is directed to a solderable aluminum alloy having an aluminum alloy which is formable into a substrate. The aluminum alloy has 0.05–4.5% by weight of tin added to the aluminum alloy to be formed into the substrate.

Other elements may be added to improve wetting characteristics of the aluminum material.

The invention is further directed to a process for preparing a solderable aluminum substrate. The process includes preparing an aluminum slug with 0.05–4.5% of tin added to the aluminum slug; then rolling the aluminum slug to the desired thickness for the substrate; finally forming the rolled slug into the final shaped of the substrate.

The invention is directed to an alloy of aluminum which is easily formable into a variety of different shapes. The alloy of aluminum is a standard aluminum alloy which incorporates tin therein to improve surface tension characteristics of the formed component and to improve the wetting characteristics.

Tin and aluminum are not generally miscible with each other at room temperature. Only a very small percentage of tin will be soluble in aluminum at room temperature. At elevated temperatures, tin is completely miscible in aluminum. However, when this composition is cooled and allowed to solidify, the tin will separate from the aluminum forming tin beads or granules within the aluminum. If the material can be cooled quickly enough, less of the tin will separate from the aluminum. This process is particularly useful for quickly cooling the surface of the material and keeping more of the tin dissolved in the aluminum along the surface of the material. It is believed that the more tin that is dissolved in the aluminum, the more wettable the surface will be with standard solder compositions and baths. Even when the aluminum is allowed to cool slowly, a very small amount of tin will remain in the aluminum thereby providing the aluminum with better solderability. However, this amount of aluminum may not be sufficient to provide good solderability for the substrate.

Typically, the aluminum alloy will be formed by dissolving the appropriate amount of tin in the molten aluminum and casting an ingot of aluminum. The ingot of aluminum will then be rolled to the desired thickness that is necessary for subsequently forming the aluminum into the component or device.

When the ingot is rolled to the desired thickness, the tin beads or granules will be exposed along the surface of the rolled substrate. Furthermore, during the rolling process, many of these beads will be broken apart and the tin will be spread or smeared across the surface of the rolled substrate. The aluminum oxide layer will also be at least partially broken up during the rolling process, thereby allowing a metal to metal bond to be formed between the smeared tin and the aluminum. Since tin is wettable by the solder, the smeared tin beads will provide a larger surface area on the rolled substrate which will be wettable.

The rolled substrate will then be formed, using standard forming techniques, into the desired substrate. The desired substrate can be an electrical contact or a shell for an electrical connector. The substrate can also be any other substrate which can be formed from the aluminum.

When the desired substrate is formed, it will have similar surface characteristics as the rolled substrate, that is, it will have tin beads along its surface, at least some of which will be broken and spread along the surface of the desired substrate. When the substrate is soldered, the tin that is spread across the surface of the substrate will provide wettable surface for the solder to adhere to the substrate.

The tin beads that are formed along the surface of the material will be partially, or mostly, buried within the material itself. Only a small portion of the bead will be exposed to the surface of the material. When the material is rolled, only that portion of the bead which is exposed to the surface of the material will be spread across the surface of the rolled substrate. Often, a large portion of the tin bead will remain encased within the substrate itself.

When the rolled substrate is formed into the desired substrate, the surface of the desired substrate will not only have the tin spread across its surface, it will also have a plurality of beads which are encased within the material of the substrate and which are partially exposed along the surface.

When the desired substrate is soldered, the hot solder will move over the surface of the substrate and will form a mechanical and an electrical bond with the tin which has been spread over the surface of the substrate. The bond between the solder and the tin will be strong due to the strong tin to tin metal interaction. In addition, the solder will form a strong mechanical and electrical bond with the tin beads which are still at least partially encased within the material itself. The mechanical bond between the substrate and the solder is very strong due to the fact that the bead is encased within the substrate and is therefore securely fastened to the substrate.

Furthermore, a strong electrical bond will be present because of the metal to metal bond between the tin beads and the aluminum. Since the tin beads are formed on the inside of the aluminum during the cooling process, the surface of the aluminum inside the cavity will not have an aluminum oxide finish. The cooling process will prevent oxygen from getting inside the cavity in which the tin bead will form. Therefore, the electrical interaction between the tin bead and the cavity will be a strong metal to metal bond. During the soldering process, it is possible that the tin bead will melt and mix with the molten solder. Once the solder cools, the material in the cavity will resolidify, either as the original tin bead, or the tin bead mixed with the solder. Since the cavity will be continuously covered with the molten solder, oxygen will continue to be excluded from the cavity thereby preventing the formation of aluminum oxides within the cavity. Therefore, a good metal to metal electrical bond will still be formed even if the tin beads melt and diffuse with the molten solder.

The aluminum alloys that would be suitable to be used in the present invention are the alloys in the series. All of these alloys have suitable forming characteristics that can be formed into components for electrical connectors or other components.

Specifically, alloys in the 1,000, 3,000 and 5,000 series of aluminum alloys would be suitable for use in this invention. All of these alloys have the necessary forming characteristics that are needed to form the components. Specifically, the alloys 3003, 3004, 5080, 5082, and 5784 provide good formability for this invention. However, the useful alloys are not limited to these five compositions. The aluminum alloys are well known in the art and will not be further described herein.

The aluminum alloys listed above would have a small percentage of tin added to the alloy. The range of this percentage is 0.05–4.5%. Specifically, the alloys listed above can each have 0.5, 1.0, 2.0 or 2.5% added to the composition. However, the invention is not limited to these specific percentages.

In addition, other materials may be added to the alloys to give optimum characteristics. For instance, materials may be added to improve the forming characteristics of the alloy. Furthermore, some materials may be added to improve the solubility of tin within the aluminum alloy or to improve the surface wettability of the alloy. Small additions of silver and other elements of similar properties may help to improve the wetability of the alloy.

The solderable aluminum alloy and the process for forming a solderable aluminum substrate of the present invention and many of its attendant advantages will be understood from the foregoing description. It is apparent that various changes may be made in the form, construction, and arrangement of parts thereof without departing from the spirit or scope of the invention or sacrificing all of its material advantages.

What is claimed is:

1. A method for reflow soldering an article, comprising the steps of:

preparing a composition of material including aluminum and tin, at least a portion of the tin being formed as a plurality of beads;

working the material composition to expose a plurality of the plurality of beads on at least one surface of the material composition; and bonding the exposed beads to solder of a solder bath.

2. The method of claim 1, wherein only a portion of at least one of the plurality of exposed beads is exposed and a remainder of the at least one of the plurality of exposed beads is buried within the material composition.

3. The method of claim 2, wherein the exposed portions are spread across the at least one surface.

4. The method of claim 1, wherein the exposed beads are spread across the at least one surface.

* * * * *